US005316271A

United States Patent [19]

Otsuka et al.

[11] Patent Number: 5,316,271

[45] Date of Patent: May 31, 1994

[54] DISCHARGE REGULATOR OF MOLTEN METAL

[75] Inventors: Takashi Otsuka, Okayama; Kenji Yamamoto, Bizen; Mototsugu Osada, Bizen; Tadao Taniguchi, Bizen; Yoshifumi Shigeta, Bizen, all of Japan

[73] Assignee: Shinagawa Refractories Co., Ltd., Tokyo, Japan

[21] Appl. No.: 768,989

[22] PCT Filed: Jun. 1, 1989

[86] PCT No.: PCT/JP89/00550

§ 371 Date: Nov. 6, 1991

§ 102(e) Date: Nov. 6, 1991

[87] PCT Pub. No.: WO91/16275

PCT Pub. Date: Oct. 31, 1991

[51] Int. Cl.[5] ..... B22D 41/14

[52] U.S. Cl. ..... 266/236; 222/598

[58] Field of Search ..... 222/591, 598, 599; 266/236

[56] References Cited

U.S. PATENT DOCUMENTS

| | | | |
|---|---|---|---|
| 3,556,360 | 1/1971 | Stelson | 222/598 |
| 4,840,295 | 6/1989 | Hartley | 222/598 |
| 5,037,017 | 8/1991 | Lührsen et al. | 222/598 |
| 5,078,306 | 1/1992 | Keller et al. | 222/598 |
| 5,106,106 | 4/1992 | Brückner et al. | 222/598 |
| 5,154,875 | 10/1992 | Luchs | 222/598 |

FOREIGN PATENT DOCUMENTS

| | | |
|---|---|---|
| 63-256265 | 10/1988 | Japan . |
| 64-75971 | 3/1989 | Japan . |

*Primary Examiner*—Scott Kastler

*Attorney, Agent, or Firm*—Larson & Taylor

[57] ABSTRACT

The present invention relates to a discharge regulator of molten metal, which can be disposed approximately vertically at the bottom portion of a molten metal vessel, characterized in that the regulator consists of a rotary nozzle, a nozzle carrying brick and a sleeve or of a rotary nozzle and a nozzle carrying brick, two or more recessed notches or openings are provided in at least either one of said nozzle carrying brick and said sleeve, the surface of said nozzle opening of the rotary nozzle, which pierces through at least one nozzle hole, is supported slidably to and in close contact with the inner peripheral surface of said nozzle carrying brick or said sleeve, and said rotary nozzle is equipped with a rotary mechanism mounted in such a manner that the upper portion of said rotary nozzle is brought into contact with the molten metal.

8 Claims, 11 Drawing Sheets

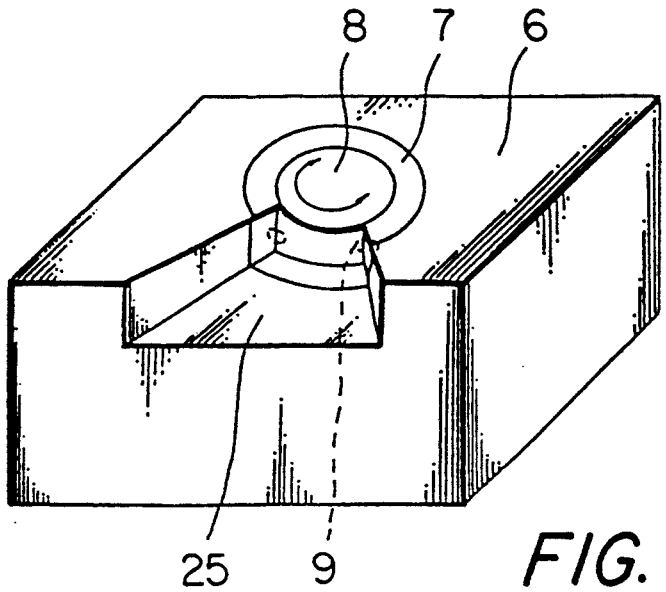
FIG. 4
FIG. 5a
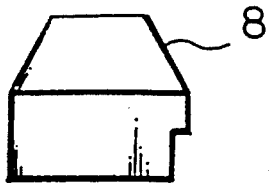
FIG. 5b
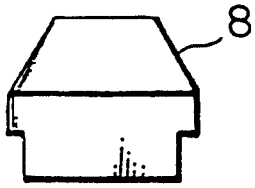
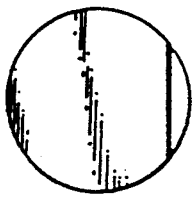
FIG. 5a'
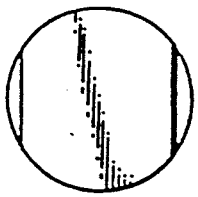
FIG. 5b'

FIG. 11a
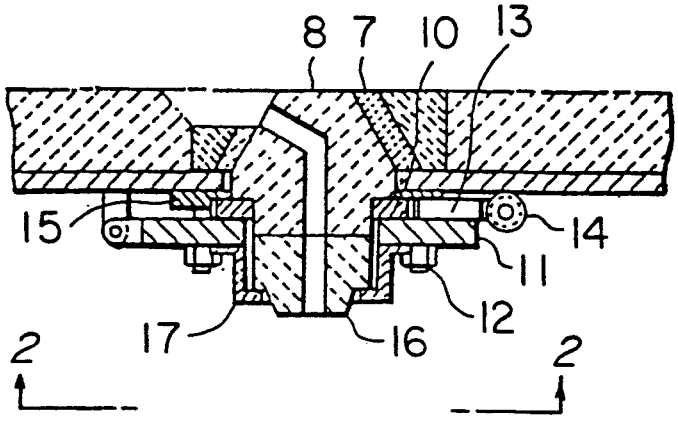
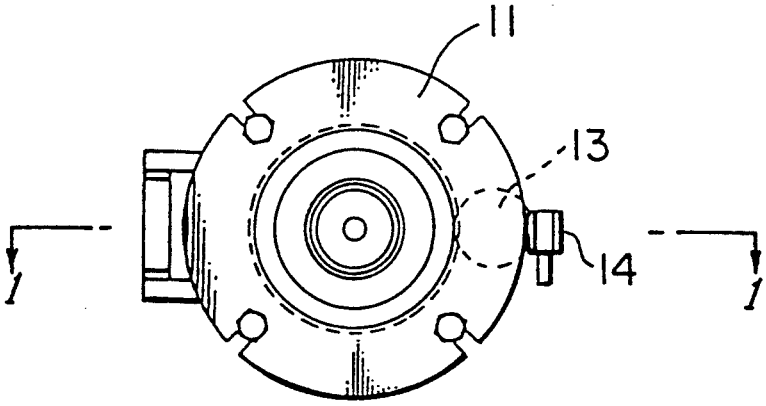
FIG. 11b

DISCHARGE REGULATOR OF MOLTEN METAL

TECHNICAL FIELD

This invention relates to a discharge regulator of molten metal, which is used when molten metal is poured from a molten metal vessel such as ladle or tundish.

BACKGROUND TECHNIQUE

A nozzle stopper system and a slide valve (sliding nozzle) system are well known as discharge regulating mechanisms of molten metal in the case of pouring a molten metal from a molten metal vessel.

It is also known that said conventional systems have the undermentioned drawbacks.

1. Nozzle stopper system

1) Since a nozzle stopper 1 approximately same in length as the molten metal vessel is required the refractory costs high.

2) As will be seen from FIG. 15 (showing a relationship of the stroke and the opening area between the slide valve and the nozzle stopper), the discharge rate greatly varies depending on a slight movement of a nozzle stopper 1 so that this system is inferior in discharge regulation.

3) Since the nozzle stopper 1 is immersed in the molten metal there occur troubles such that the nozzle stopper is broken due to melting-down or heat spalling to allow the discharge regulation to be unable.

2. Slide valve system

1) In the case of ladle, it took a time from some ten minutes to several hours during the period from receiving a molten metal in a ladle to pouring (hereinafter called casting) the molten metal because of component control, temperature control, etc. of the molten metal.

This necessitated it to fill the interior of a nozzle 2 with a filler such as sand to prevent molten metal from solidification within the nozzle thereby lowering the working efficiency. The filler is of the idea that in case the slide valve is opened the filler first flows out and then the molten metal flows out so that the nozzle naturally opens. However, the molten metal permeates into the filler thereby to be solidified there and the nozzle sometimes does not naturally open. This necessitates the nozzle 2 to be forcedly open by an oxygen lance thus compelling the operator to a dangerous work.

2) In the case of tundish, it is unallowed to use a filler or the like in the light of quality of molten metal, and it is necessary to apply refractory, steel pipe or the like to the upper outer periphery of the nozzle so that the nozzle may open after the molten metal has accumulated in a predetermined amount. This causes unfavorable workability and high cost.

3) Again in the case of tundish, there is a method of preventing the molten metal within the nozzle from solidification by injecting an inert gas from a fixed plate 3 or a slide plate 4 as shown in FIG. 16 instead of using refractory or steel pipe. However, in such a case the mechanism of introducing the inert gas becomes complicate and it costs high.

Further, even in the method (c) above, 100% success would not be expected and the molten metal within the nozzle sometimes solidifies thereby disabling the casting from starting.

Furthermore, even when an immersion nozzle in replaced while casting the nozzle is closed, and therefore the inconvenience same as above occurs.

4) The nozzle is occasionally opened fully while casting due to an erroneous operation or any necessity. However, since the molten metal solidifies within the nozzle if the nozzle is retained fully open for a long period of time, a forced opening of the nozzle becomes necessary.

5) Since this system has a number of connecting portions and there is a great risk of inhating air from the exterior of the refractory, it is greatly possible that the quality of the product is reversely affected.

Moreover, a rotary valve as shown in FIG. 17 is a new modern technique. This system is characterized in that it consists of a rotor 20, a dome nozzle 21 and a drive mechanism 20*a*, the dome nozzle 21 is fixed to a tundish 23 and the rotor 20 is turned to permit the discharge flow of the molten metal to be regulated. However, even this system has the undermentioned demerits.

1) Since the rotor 20 is immersed in the molten metal a trouble occurs such that the rotor is broken due to melting-down or heat spalling, and the discharge regulation becomes disabled occasionally.

2) Since the rotor 20 is longer than the height of tundish 23 the system is costly.

3) In the initial state of casting, a nozzle 22 is fully opened, the molten metal is poured into the tundish 23, the nozzle 22 is opened after the molten metal has been accumulated in a predetermined amount, and then the casting working is started. However, the nozzle 22 itself cannot be prepared so great under the following reasons, so that the molten metal solidifies because of the lowered temperature of the molten metal within the nozzle 22 thereby disabling sometimes the casting from starting.

That is, to make the nozzle 22 large-sized results in that the rotor 20, the dome nozzle 21 and other related members need to be large-sized whereby it leads to an increase of cost and problematical workability. Thus, to make the nozzle 22 large-sized is naturally limited to a certain extent.

On the other hand, in an emergency such as incorrect operation during the casting working or overflow of the molten metal within the mold the nozzle 22 may occasionally be opened fully, but in such a case the molten metal within the nozzle 22 solidifies as described above when it becomes impossible to restart the casting.

4) Since the rotor 20 is great and heavy its handling and setting work is inconvenient.

DISCLOSURE OF THE INVENTION

The present invention relates to a discharge regulator of molten metal, which can be disposed at the bottom portion or side portion of a molten metal vessel, characterized in that the regulator consists of a rotary nozzle, a nozzle carrying brick and a sleeve or of a rotary nozzle and a nozzle carrying brick, two or more recessed notches or openings are provided in at least either one of said nozzle carrying brick and said sleeve, the surface of said nozzle opening of the rotary nozzle, which pierces through at least one nozzle hole, is supported slidably to and in close contact with the inner peripheral surface of said nozzle carrying brick or said sleeve, and said rotary nozzle is equipped with a rotary mechanism mounted in such a manner that the upper portion of said rotary nozzle is brought into contact with the molten metal.

BRIEF DESCRIPTION OF THE DRAWINGS

FIGS. 1, 2, 3, 4, 5*a*, 5*b*, 5*a'*, 5*b'*, 6, 7, 8, 9*a*, 9*b*, 10, 11*a*, 11*b*, 12, 13, and 14 are schematic views showing the embodiments of the apparatus of the invention;

BEST EMBODIMENT FOR CARRYING OUT THE INVENTION

The invention will now be described more in detail, by way of some embodiments, with reference to the accompanying drawings.

Figure 1:
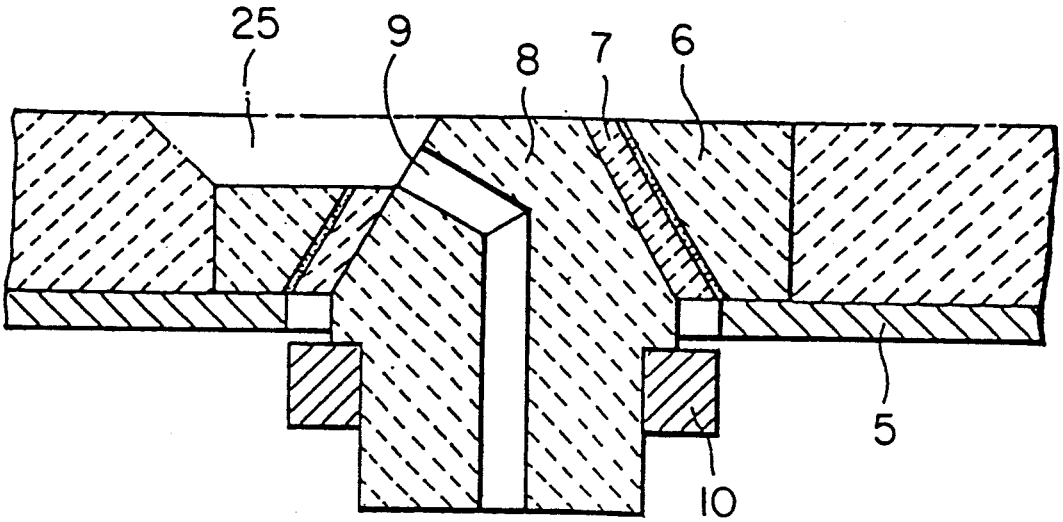

As shown in FIG. 1, a sleeve 7 is fixed with mortar to a nozzle carrying brick 6 fixed also with mortar at the bottom portion or the side portion of a molten metal vessel 5, a rotary nozzle 8 is in close contact with the tapered portion or straight portion of the inner surface of said sleeve 7 and rotatably supported by a rotation controlling case 10 (hereinafter called case), and the discharge of molten metal is regulated by rotating the rotary nozzle 8.

The invention will be described more in detail with reference to FIGS. 1 to 5. As will be seen from these figures, the rotary nozzle 8 is a shape of truncated cone, and as shown in FIG. 5, its lower portion is provided with two or more driving flat surfaces parallel to the axis of rotation of the rotary nozzle 8, an L-shaped nozzle hole 9 is provided from the tapered portion of the side surface of the sleeve toward the lower portion, and a recessed notch 25 is provided in the sleeve 7 and the nozzle carrying brick 6 so that the molten metal may flow in from said nozzle hole 9 of the tapered portion.

Figure 3:
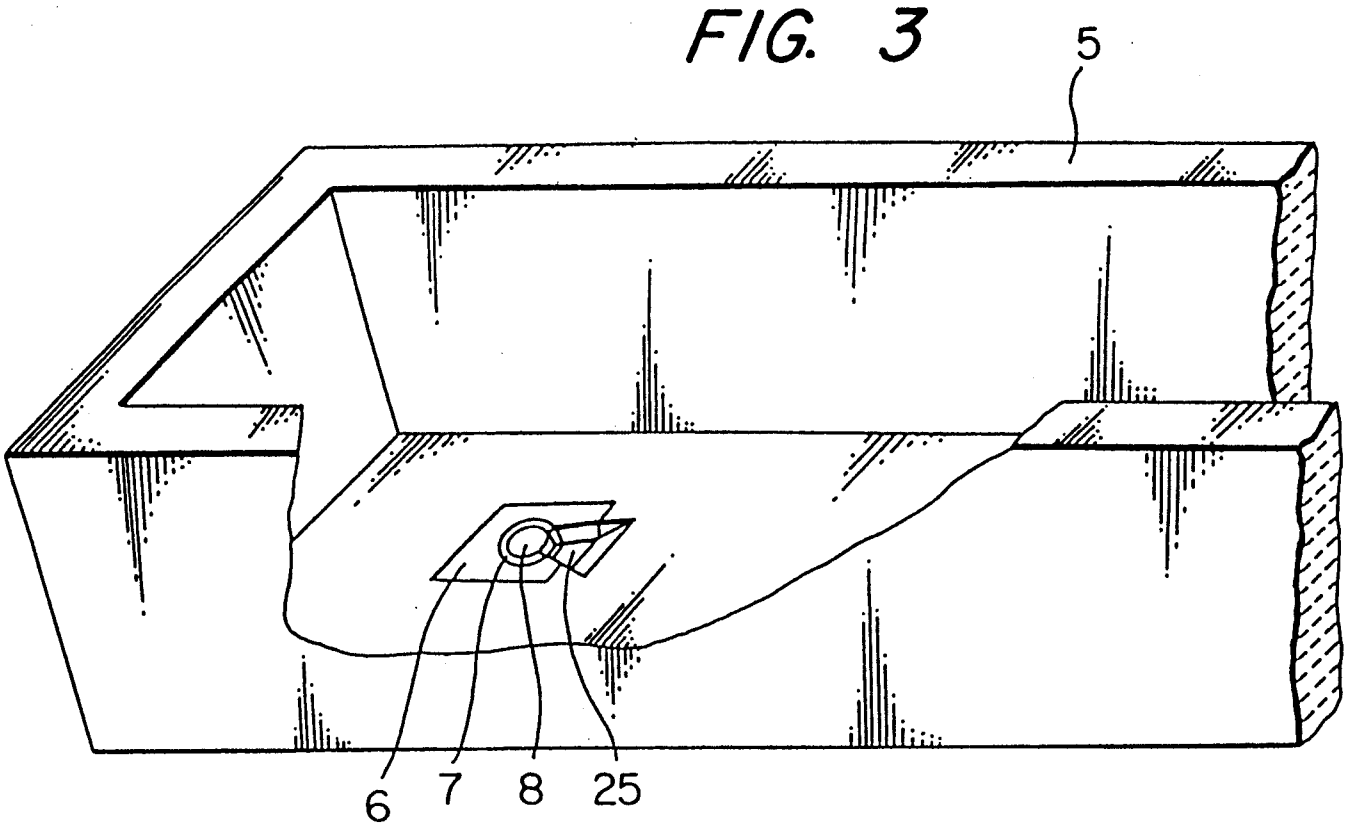

As shown in FIGS. 3 and 4, said recessed notch is provided at least one in the zone from the upper surfaces of the nozzle carrying brick 6 and the sleeve 7 to the side surfaces thereof, and it refers to a notched portion irrespective of straight line cut or curved line cut and irrespective of shape. The sleeve 7 is fixed to the nozzle carrying brick 6 with mortar so as not to be rotable. In order that the rotary nozzle 8 and the sleeve 7 are brought into close contact so that molten metal may not enter into their close contact surfaces, and that the rotary nozzle 8 is rotatably supported, said rotary nozzle 8 is supported by a case 10. As shown in FIG. 11, the outer periphery of said case 10 is provided with a transmission means (as shown FIG. 11) such a gear or link to transmit turning force, and said transmission means is driven by a driving means (not shown) such as electric motor, oil pressure motor or oil pressure cylinder thereby to regulate the discharge flow of the molten metal.

The invention will then be described in respect of the using method based on the regulation mechanism thus constructed. Firstly, the rotary nozzle 8 is turned to move the nozzle hole 9 to a place other than the recessed notch 25 of the sleeve 7 and nozzle carrying brick 6 to bring the nozzle hole 9 to a blocked state, when molten metal is received into a vessel.

Casting of molten metal is effected by turning the rotary nozzle 8 to bring the nozzle hole 9 into an engagement with the recessed notch 25 of the sleeve 7 and nozzle carrying brick 6.

As shown in FIG. 4, the discharge of the molten metal is regulated by turning the rotary nozzle 8 to block (squeeze) the nozzle hole 9 by the edge of the recessed notch 25 of the sleeve 7. Further, such a discharge regulation can be carried out at two places of A portion and B portion in FIG. 2.

Though the invention has been described by way of one embodiment it may be possible that the dimension of the recessed notch of the sleeve 7 and nozzle carrying brick 6 is made to such an extent that the nozzle hole 9 of the rotary nozzle 8 may not be blocked, to be sufficiently large-sized.

It is also possible that said nozzle hole 9 and said recessed notch 25 need not be provided at singular places but at several places.

Figure 6:
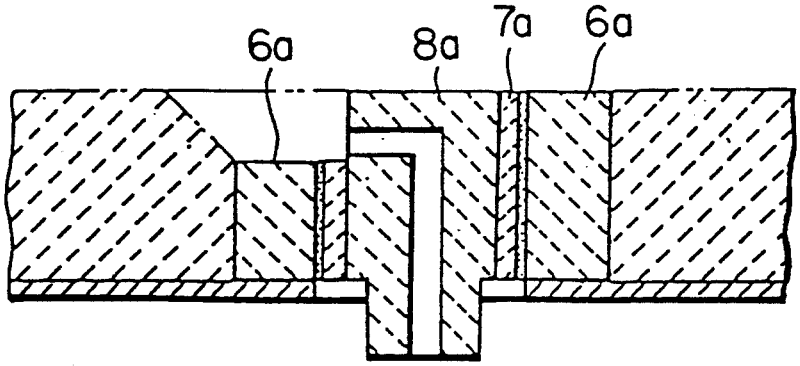
Figure 7:
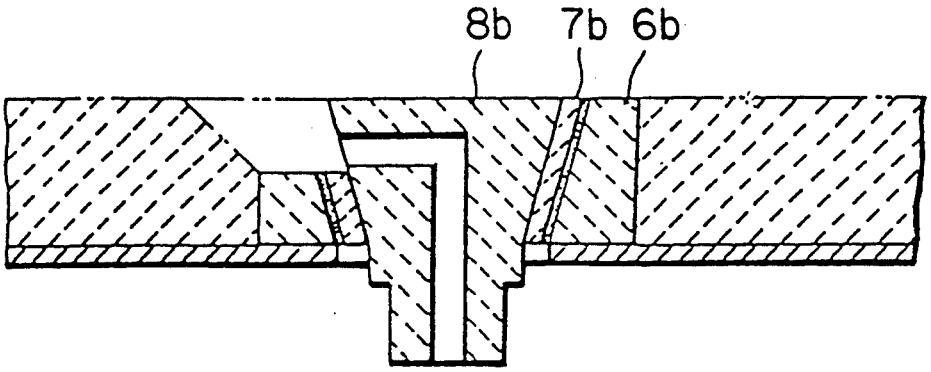

The outer shape of the rotary nozzle 8 may be, in its outer periphery, straight line 8*a* (column) or reversely tapered line 8*b* (upturned truncated cone), as shown in FIGS. 6 and 7.

Figure 8:
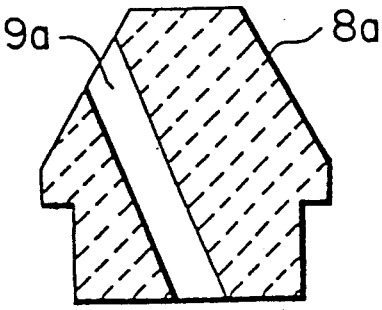
Figure 9A:
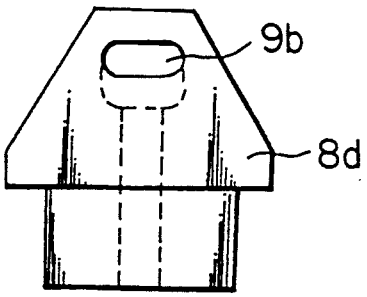
Figure 9B:
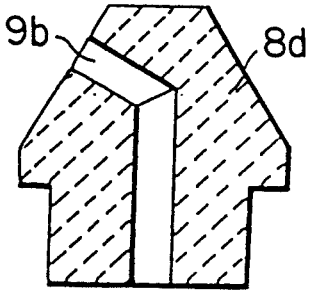

The shape of the nozzle hole 9 may be straightly piercing hole 9*a* obliquely from the tapered surface as shown in FIG. 8 or elliptic 9*b* in its sectional view as shown in FIG. 9*a* and FIG. 9*b*.

Figure 10:
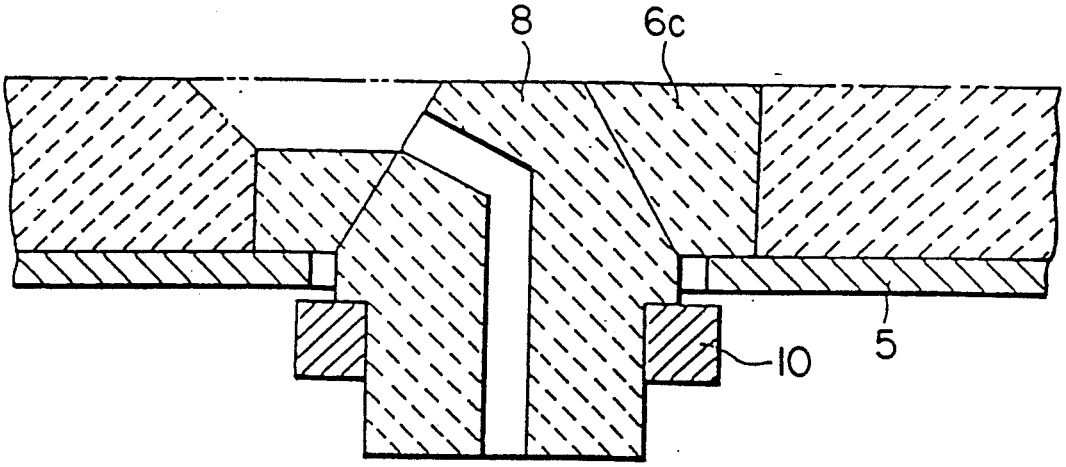
Figure 12:
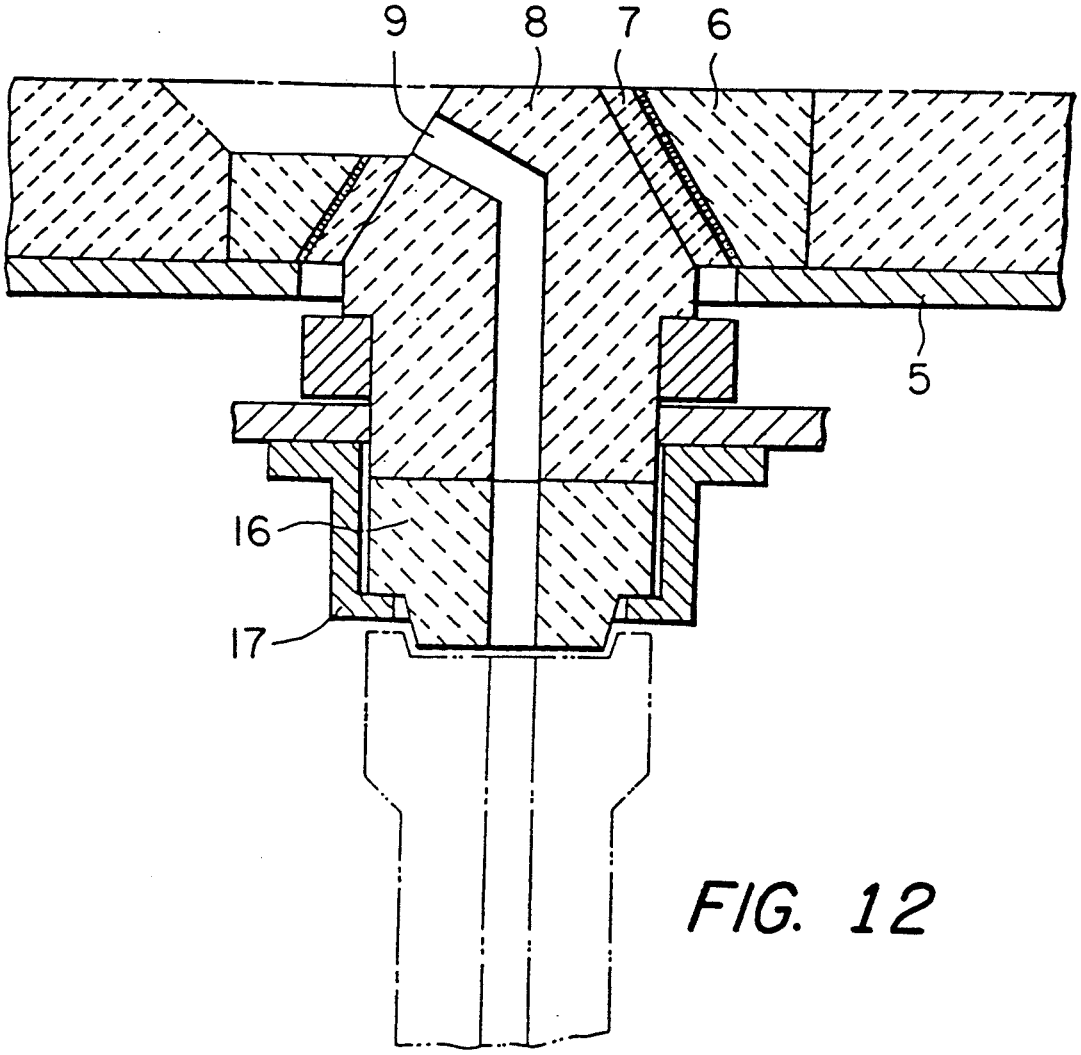

The combination of the rotary nozzle 8 with the sleeve 7 and the nozzle carrying brick 6 may be replaced even by a combination of the rotary nozzle 8 with the nozzle carrying brick 6*c* as shown in FIG. 10.

One embodiment of the device of supporting said rotary nozzle 8 is shown in FIG. 11. The case 10 retained at the flat surface in the lower portion of the rotary nozzle 8 to impart rotation to the rotary nozzle, is rotatably retained by an outer case 11, and it is secured by a bolt and nut 12 to a fixed base 15 welded or bolted to the molten metal vessel 5. Gearing is provided in the outer periphery of the case 10, a reduction gearing 13 is provided between the case 10 and the outer case 11, a worm gearing 14 is provided further outside the reduction gearing 13, and the worm gearing 14 is provided with a drive source (not shown) such as electric motor or oil pressure motor whereby the rotation of the rotary nozzle 8 is controlled.

Then, an embodiment of incorporating an intermediate nozzle 16 is described with reference to FIG. 13.

The rotary nozzle 8, the sleeve 7 and the nozzle carrying brick 6 are the same as those illustrated in FIG. 1, but in this mechanism an intermediate nozzle 16 is provided beneath the rotary nozzle 8.

Said intermediate nozzle 16 is in close contact with the rotary nozzle 8 by means of a case 17, and it is fixed so that it may move even if the rotary nozzle 8 turns.

Figure 13:
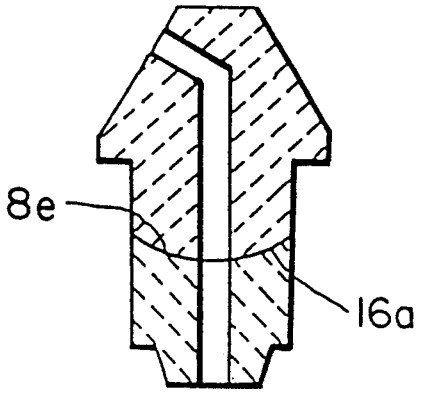
Figure 14:
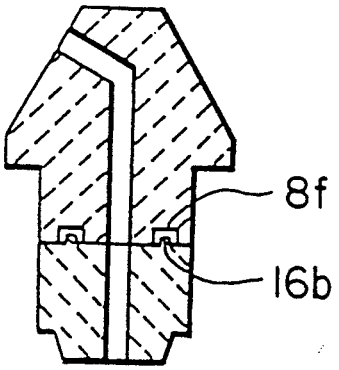
Figure 15:
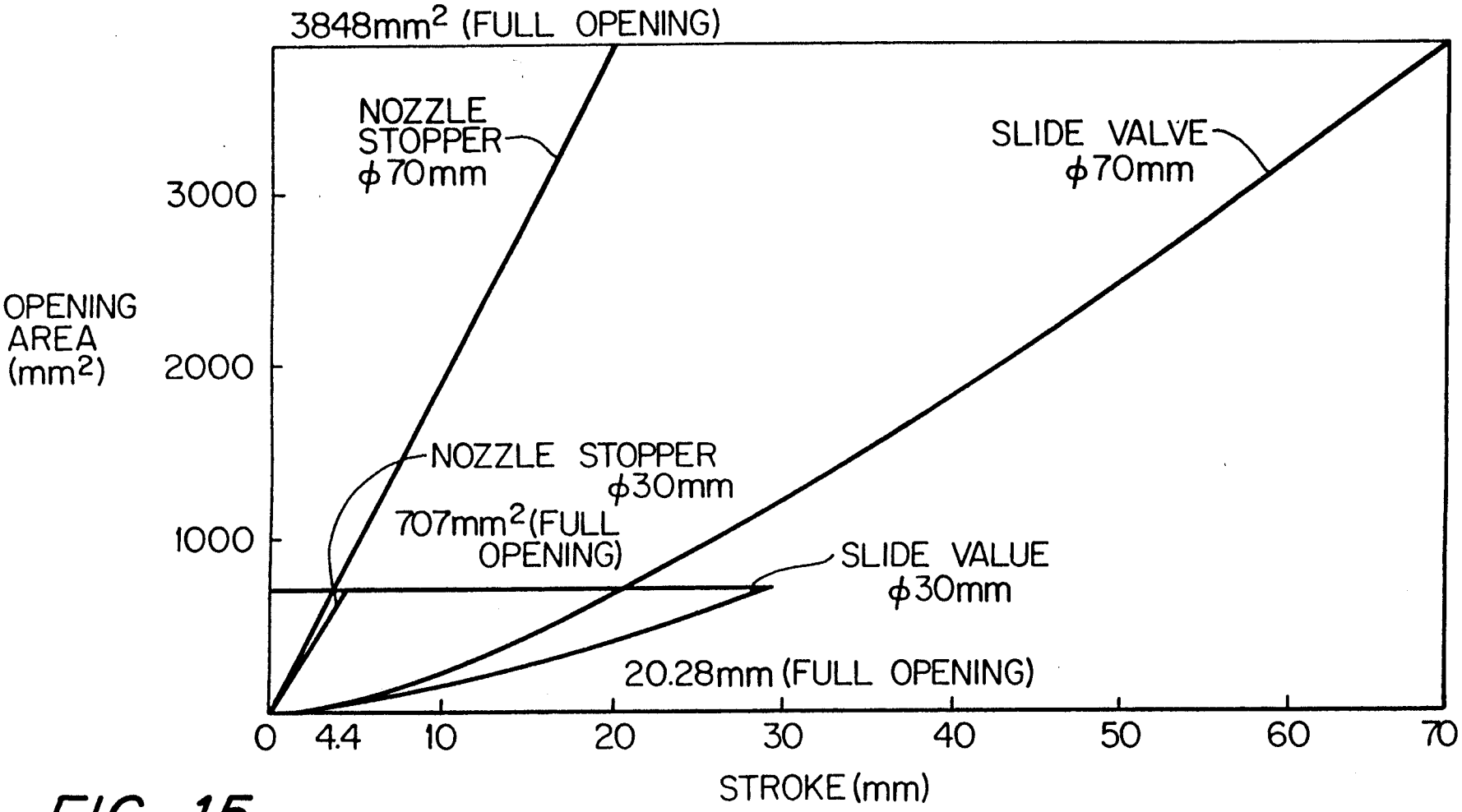
FIG. 15 is a graph showing a relationship of storke and opening area between the slide valve system and the nozzle stopper system.
Figure 16:
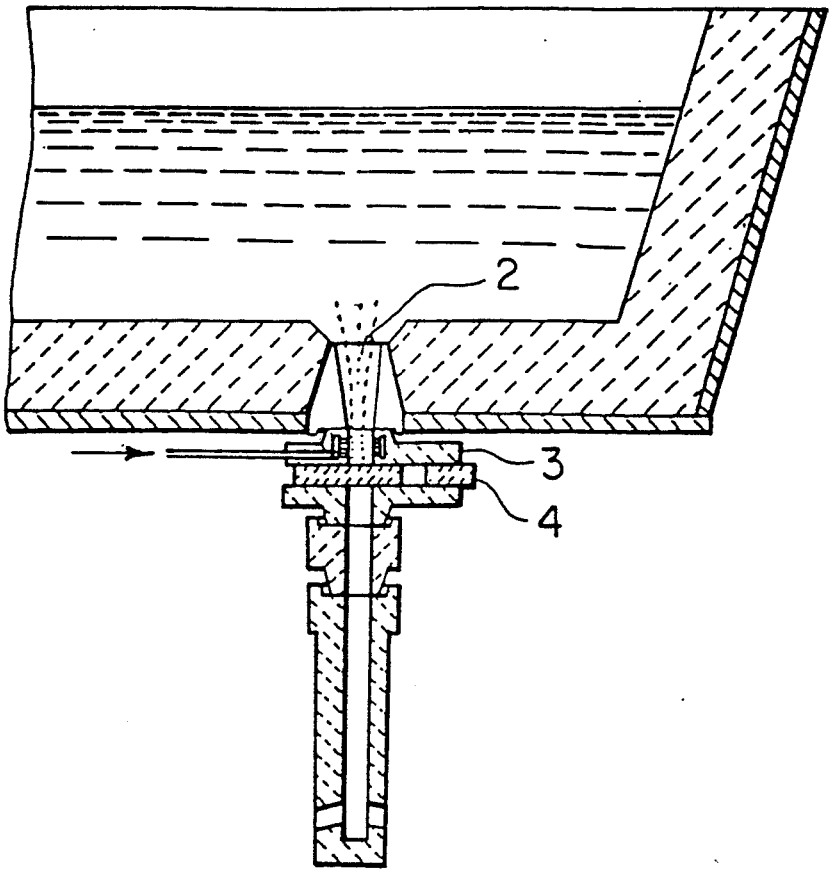
FIGS. 16 and 17 are schematic views of known examples.
Figure 17:
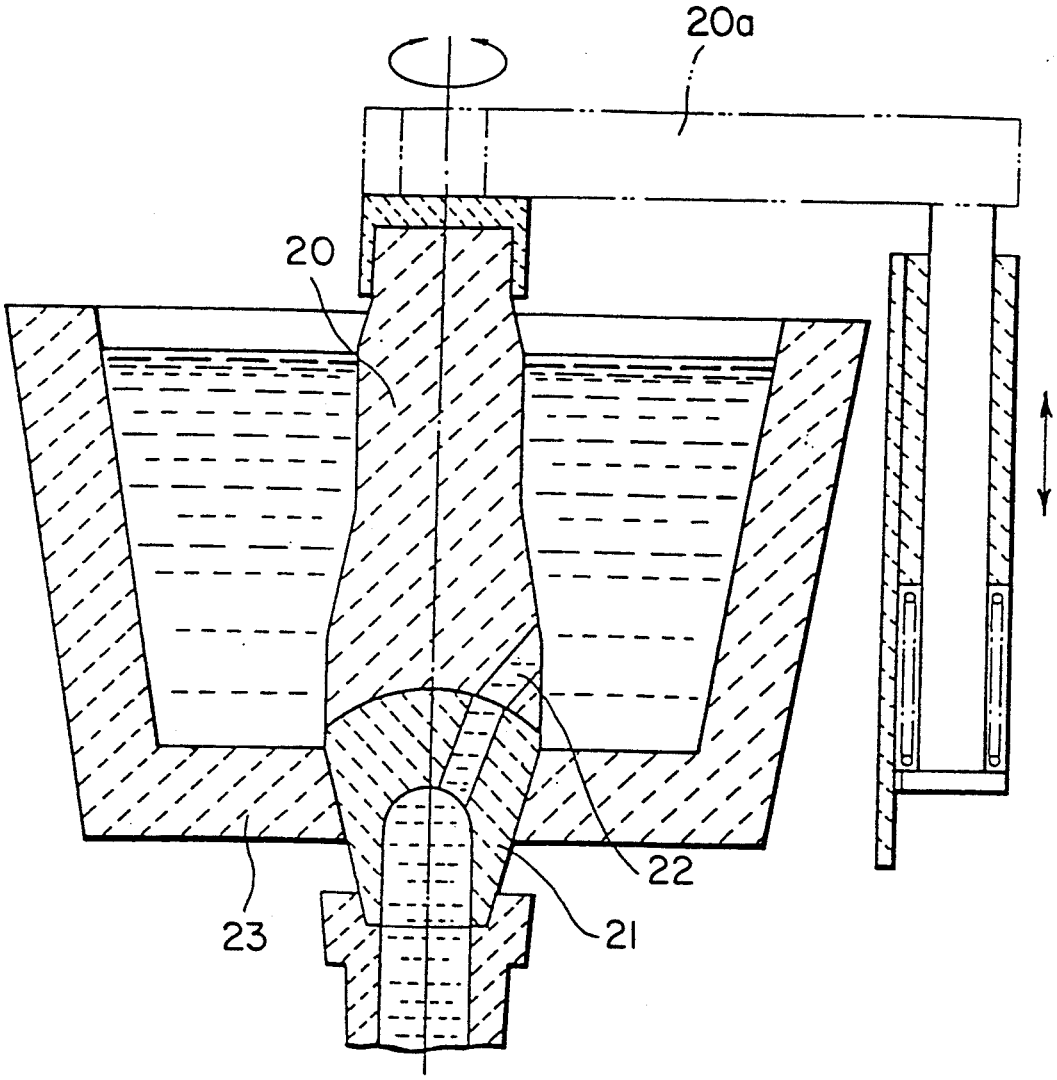

The contact surfaces of the intermediate nozzle 16 and the rotary nozzle 8 may be formed plane or in spherical surfaces 8*e*, 16*a* or an engaging shape of two or more convexes and concaves 8*f*, 16*b* as shown in FIGS. 13 and 14.

Additionally, this mechanism is effective when a lower nozzle such as immersion nozzle or long nozzle is used.

According to the discharge regulator of the present invention, the problems encountered in known techniques are all solved and it has the following merits.

(1) Since molten metal does not enter into the nozzle hole 9 at the start of casting, not only a filler is unnecessary but also injecting of an inert gas is not required. Cost is therefore low and a stable operation becomes possible.

(2) Even when an immersion nozzle or the like is replaced while casting the molten metal does not enter into the nozzle hole 9 when the nozzle is closed, and therefore, the same effect as in (1) above is produced.

(3) The entire mechanism has less connection portions than the slide valve system, so that the external air is less inhaled thereby improving the quality of the product.

(4) Since the regulator is compact and refractory is used in a smaller amount the cost becomes low. Further, refractory members can be easily replaced.

Figure 2:
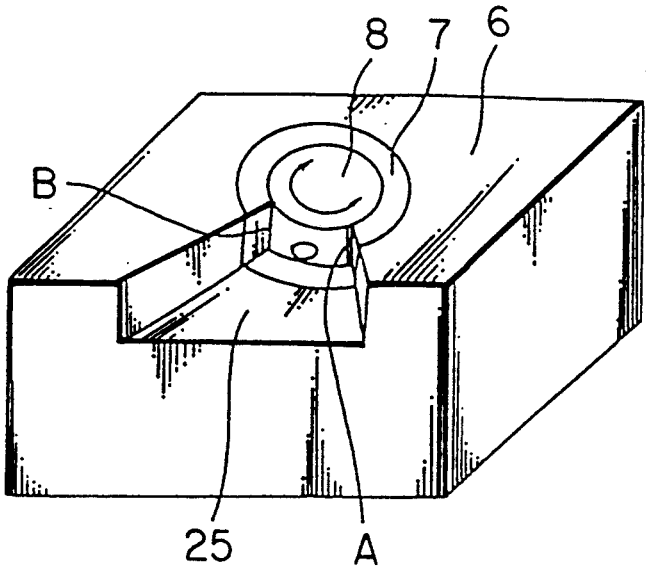

(5) Since the discharge flow can be regulated at two places of A portion and B portion as shown in FIG. 2, the discharge regulating property and the life of the regulator are superior to conventional techniques.

INDUSTRIALLY POSSIBLE APPLICATION

The present invention is used as a discharge regulating system when molten metal is poured from a molten metal vessel.

We claim:

1. In a metallurgical vessel having a rotary valve unit for controlling the discharge of molten metal from the interior of said vessel, the improvement wherein said rotary valve unit comprises:

a rotary nozzle having a nozzle hole for the flow of molten metal, a nozzle-carrying brick in which said nozzle is mounted for rotation, said brick being fixedly mounted in a wall of said vessel, the internal end surfaces of said rotary nozzle and said brick being flush with the inner surface of the wall of the vessel in which the rotary nozzle unit is mounted, said brick having at least one notch in its inner surface, said notch extending to the outer surface of said rotary nozzle, and means for rotating said rotary nozzle to bring said nozzle hole into alignment with said notch to permit molten metal in said vessel to flow through said nozzle hole to thereby discharge said molten metal from the interior of said vessel.

2. A metallurgical vessel according to claim 1, wherein said rotary valve unit further comprises a sleeve surrounding said rotary nozzle, said sleeve being fixedly mounted to said nozzle-carrying brick, the internal end surface of said sleeve being flush with the inner end surface of said rotary nozzle and said brick, said nozzle being mounted for rotation in said sleeve, and said notch extending through said sleeve.

3. A metallurgical vessel according to claim 1 or 2 wherein said rotary nozzle is of truncated cone shape, reversed truncated cone shape, or column shape.

4. A metallurgical vessel according to claim 1 or 2 wherein said nozzle hole is L-shaped, the stem of the L-shaped nozzle hole being disposed along the axis of rotation of said rotary valve, and the arm of the L-shaped nozzle hole extending laterally.

5. A metallurgical vessel according to claim 4 wherein the lateral portion of said nozzle hole is circular or elliptical in cross section.

6. A metallurgical vessel according to claim 1 or 2 further comprising an intermediate nozzle in close contact with the lower end of said rotary nozzle.

7. A metallurgical vessel according to claim 6 wherein the engaging surfaces of said rotary nozzle and said intermediate nozzle are spherical or uneven and irregular.

8. A metallurgical vessel according to claim 1 or 2 wherein said rotating means comprises a rotation controlling can which supports said rotary nozzle for rotation in said nozzle-carrying brick.

* * * * *